United States Patent [19]

Takata

[11] Patent Number: 4,457,120

[45] Date of Patent: Jul. 3, 1984

[54] FLOOR PAVEMENT STRUCTURE

[75] Inventor: Fumio Takata, Kobe, Japan

[73] Assignee: Sumitomo Gomu Kogyo Kabushiki Kaisha, Kobe, Japan

[21] Appl. No.: 363,467

[22] Filed: Mar. 30, 1982

[30] Foreign Application Priority Data

Mar. 31, 1981 [JP] Japan ..... 56-48729

[51] Int. Cl.[3] ..... B32B 3/18; E04C 1/00

[52] U.S. Cl. ..... 52/309.4; 52/309.6; 52/309.8

[58] Field of Search .... 52/309.4, 309.5, 309.7–309.17, 52/309.6

[56] References Cited

U.S. PATENT DOCUMENTS 3,106,751 10/1963 Fish ..... 52/309.5
3,461,844 8/1969 Harrison ..... 52/309.12 X
3,684,630 8/1972 Sensenig et al. ..... 52/309.8

FOREIGN PATENT DOCUMENTS 1800905 6/1970 Fed. Rep. of Germany ..... 52/309.5
2361870 7/1974 Fed. Rep. of Germany ..... 52/309.8
1548163 10/1968 France ..... 52/309.4

*Primary Examiner*—J. Karl Bell
*Attorney, Agent, or Firm*—Robert E. Burns; Emmanuel J. Lobato; Bruce L. Adams

[57] ABSTRACT

A floor pavement structure comprises a base material formed by concrete or asphalt or the like, a cushioning layer laminated over the base material, a filler layer applied to the cushioning layer, and an overcoat laminated over the filler layer. The filler layer comprises a foaming synthetic resin such as foaming polyurethane having innumerable air bubbles therein.

11 Claims, 1 Drawing Figure

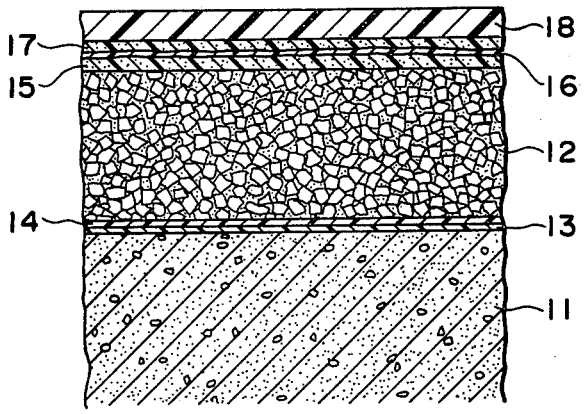
17
15
14
18
16
12
13
11

FLOOR PAVEMENT STRUCTURE

FIELD OF THE INVENTION

The invention relates to a floor pavement structure which is suitable for use in the construction of a floor of a gymnasium or tennis court or the like, and more particularly, to an elastic floor pavement structure including a lamination of a cushioning layer formed by an elastic material, on a base material such as concrete or asphalt.

DESCRIPTION OF THE PRIOR ART

An elastic floor structure including a base material formed by concrete or asphalt and on which a cushioning layer is laminated, which comprises globules or particles of rubber or asphalt bonded together by means of a resin with fine spaces formed between adjacent particles, and also including an overcoat of a synthetic resin such as polyurethane applied to the cushioning layer, is extensively used, as disclosed in U.S. Pat. No. 3,801,421, for example. In such structure, an adhesive is applied between the cushioning layer and the concrete, but there is a likelihood that a solution of adhesive may permeate into the cushioning layer to fill the fine spaces, thus reducing the elasticity of the cushioning layer.

To accommodate for this, the present inventor has proposed in Japanese Laid-Open Utility Model Application No. 62,737 / 1980 to provide a filler layer formed by particles of organic or inorganic materials having relatively small diameters, as a dispersion over the cushioning layer. Since the filler layer comprises fine particles, it is essential that an intermediate coat be applied to the filler layer, followed by a smoothing treatment, again followed by another intermediate coat. The purpose of the intermediate coat is to provide a smooth and dense surface of the base. As a result of these steps, a manual intervention is required in the distribution of the particulate filler and the smoothing treatment, resulting in an elongated work period and an increased cost. The difficulty in providing a uniform distribution of the particulate filler causes the filling accuracy to be dependent upon the skill of an operator.

SUMMARY OF THE INVENTION

It is an object of the invention to provide a floor pavement structure which is simple to work and provides a soft sensation to the walking foot.

It is another object of the invention to provide a floor pavement structure having a filler layer which is formed by a simple process without reducing the elasticity of a cushioning layer.

In accordance with the invention, there is provided a floor pavement structure comprising a base material such as concrete or asphalt, a cushioning layer laminated over the base material and including an increased number of elastic particles bonded together by a binder with fine air spaces formed therebetween, a filler layer formed on top of the cushioning layer by applying an unhardened foaming synthetic resin material containing innumerable air bubbles, and an overcoat layer laminated over the filler layer.

In a preferred embodiment of the invention, the foaming synthetic resin material which forms the filler layer comprises foaming polyurethane having a foaming factor of 1 to 4. This prevents the permeation of the filler material into fine spaces formed in the cushioning layer and assures a satisfactory elasticity. Rubber particles and/or fibres of small diameters may also be included while using the foaming polyurethane as the main material, thus achieving a more reliable filling effect on top of the cushioning layer.

In another preferred embodiment of the invention, the structure may include a barrier formed by applying a one-liquid polyurethane, for example, in order to prevent contaminating material produced by the elastic particles in the cushioning layer from permeating into the overcoat layer.

BRIEF DESCRIPTION OF THE DRAWING

The single FIGURE of drawing is a cross section of a floor pavement structure according to one embodiment of the invention.

DESCRIPTION OF PREFERRED EMBODIMENT

Referring to the drawing, there is shown a base material 11 which may comprise concrete or asphalt or the like. A cushioning layer 12 is laminated over the base material, and is formed by a mixture of a binder and an increased number of elastic particles, desirably blended at a weight ratio of 1:3 to 1:16. The surface of the base material 11 is preferably provided with a seal coat 13 and a primer 14 beforehand. Specifically, the seal coat 13 is formed by applying epoxy resin or polyurethane, diluted with a thinner, to the surface of the base material 11, whereby the resin permeates into the surface of the material 11 to a depth of 2–3 mm, thus increasing the surface strength of the material 11. The primer 14 comprises the same material as the binder resin used in the cushioning layer 12, and is applied to the seal coat 13 in order to increase the bonding strength between the elastic particles of the cushioning layer 12 and the base material 11, when the cushioning layer 12 is laid before the seal coat 13 becomes hardened.

The binder resin used in combination with the elastic particles may comprise rubber or plastics including a latex of natural or synthetic rubber, liquid rubber, liquid plastics, and resin emulsions such as ethylene acetate vinyl copolymer resin having a rubber-like elasticity. The most preferred binder is liquid polyurethane. The elastic particles preferably comprise rubber chips or cork chips having an average particle diameter on the order of 1 to 10 mm. The binder resin and the elastic particles are mixed together at a ratio of 1:3 to 1:16. If the proportion of the binder resin exceeds the upper limit of the above ratio, the fine air spaces which are left between the elastic particles will be filled by the binder resin. On the contrary, when the proportion of the binder resin is less than the lower limit of the ratio defined above, the adhesion between the elastic particles is less than satisfactory. In the cushioning layer 12 thus formed, fine air spaces or voids are left between adjacent elastic particles internally of the layer, whereby the floor surface obtains an elasticity, an acoustic isolation and a heat insulation. The thickness of the cushioning layer 12 depends on the intended application, but may have a value from 9 to 15 mm for the floor of a gymnasium, and a value of approximately 7 mm for a tennis court, for example.

A filler layer 15 is then formed on top of the cushioning layer 12 by applying a foaming synthetic resin, which is foamed on site, while it is unhardened. A most preferred foaming synthetic resin is foaming polyurethane. It is to be understood that the expression "foaming synthetic resin foamed on site" is used in contrast to the expression "synthetic resin foam" which is hardened and molded into a sheet form in a factory. Specifically, it refers to a liquid urethane resin having innumerable air bubbles in the polyurethane when the polyurethane and a hardener are subject to a stirring action in an agitator into which air is easily entrained, with or without the addition of a foaming agent. Preferred foaming factor of the polyurethane is from 1 to 4 in consideration of the filling effect and the resulting floor performance. If the foaming factor is less than unity, the foaming polyurethane liquid will permeate into the gaps or voids between the elastic particles of the cushioning layer 12, resulting in a poor filling effect. On the other hand, a foaming factor which exceeds 4 tends to reduce the bouncing effect of the floor. By experiments, it is found that the foaming polyurethane preferably has a hardness on the order of 40°–70° and an elongation of 30 to 100%. When the elongation is less than 10%, surface cracks may be formed when subjected to a repeated impacting. The unhardened, foaming synthetic resin may also contain rubber particles of small diameters and/or fibres as required, thereby allowing the filling effect to be improved. As described, the filler layer 15 essentially comprises a foaming synthetic resin, and may also contain rubber particles of small diameters and/or fibres, if desired. It covers the top of the cushioning layer 12 to provide a positive filling effect. In addition, it may have flattening effect. A suitable thickness of the filler layer 15 is on the order of 1 mm.

The surface of the filler layer 15 may be subjected to a smoothing treatment, if desired, in order to provide a satisfactory finish for the floor surface. The smoothing treatment may be performed by utilizing a polisher, which is used for purpose of cleaning tiles, for example, to which sandpaper is attached. In the prior art practice, fine particles are dispersed to provide a filler layer as mentioned previously, so that it has been essential to provide an intermediate coat over the filler layer, followed by a smoothing treatment, which is again followed by another intermediate coat. However, in accordance with the invention, the surface of the filler layer 15 may be directly subjected to a smoothing treatment, and hence the number of intermediate coats can be reduced at least by one.

After the smoothing treatment, a barrier 16 is preferably formed by the application of one liquid polyurethane, for example, in order to prevent contaminating material which is produced by the elastic particles in the cushioning layer from moving toward the surface.

Subsequently, a liquid resin or a mixture of liquid resin and fine sand is applied to the top of the filler layer 15 or the barrier 16 to form an intermediate coat 17. The purpose of the intermediate coat 17 is to provide a smooth and dense surface for the base, to which a surface layer 18 is applied, thus providing a satisfactory surface finish and improving the strength. The mixture of liquid resin and fine sand may comprise a mixture of liquid resin, silica sand and a thinner with a weight proportion of 1:2:0.1–0.3. Since the filler layer 15 comprises unhardened, foaming synthetic resin in accordance with the invention, the uneveness of the cushioning layer 12 is suitably corrected and smoothed by the foaming material. Hence, a single step of smoothing treatment and intermediate coating is sufficient for the intended purpose. However, to assure a better surface finish, the smoothing treatment and the intermediate coating may be repeated. The intermediate coat 17 essentially comprises a resin, and may also include fine sand dispersed in the resin. A suitable thickness is on the order or 0.5 mm.

In accordance with the invention, the filler layer 15 is provided in a simple manner by the application of a foaming synthetic resin, and achieves a reliable filling effect. Since the foaming synthetic resin is coated over the cushioning layer 12, the number of intermediate coats can be reduced, resulting in an overall reduction in the work period, the labor required and the resulting cost.

The invention will be described below by way of Example.

EXAMPLE

20% by weight of liquid polyurethane is mixed with rubber chips having a maximum particle diameter of 3.0 mm and a minimum particle diameter of 0.5 mm, and the mixture is laid over a floor plate to a thickness of 12 mm, thus forming a cushioning layer 12. Polyurethane is foamed on site and applied to the cushioning layer 12 while the polyurethane is unhardened, thus providing a filler layer 15. The foaming polyurethane has a foaming factor of 2, a specific gravity of 0.6, a hardness of 60° and an elongation of 50%. The surface of the filler layer 15 is subjected to a smoothing treatment by means of a sandpaper, and after the application of a barrier 16, a liquid mixture of polyurethane, silica sand and a thinner at a weight ratio of 1:2:0.2 is applied to provide an intermediate coat 17. Liquid polyurethane is applied on top of the intermediate coat 17 to provide a surface layer 18. The resulting floor surface has an excellent elasticity, acoustic isolation and heat insulation, and is most suitable for use as the floor of a gymnasium.

The table below shows a comparison between the number of days required in the individual steps used in the described embodiment and the number of days required in the corresponding steps in a conventional process in which particulate material is distributed to provide a filler layer. It will be seen that up to the step of providing an intermediate coat, the work period can be reduced at least by two days according to the Example.

| Conventional Process | | Example | |
|---|---|---|---|
| Steps | Number of Days, inclusive of drying | Steps | Number of Days, inclusive of drying |
| rubber chips | one | rubber chips | one |
| filler | two | foaming polyurethane | one |
| intermediate coat | one | — | — |
| smoothing treatment & barrier | one | smoothing treatment & barrier | one |
| intermediate coat | one | intermediate coat | one |

What is claimed is:

1. A floor pavement structure comprising a base material formed of concrete or asphalt or the like;

a cushioning layer laminated over the base material and comprised of a mixture of a multiplicity of elastic particles bonded together with a binder so as to leave fine air voids between the elastic particles to assist in imparting a desired elasticity to the cushioning layer;

a filler layer formed on the cushioning layer by the application of an unhardened, foaming synthetic resin material containing therein numerous air bubbles, the filler layer being effective to prevent permeation of the resin material into the fine voids of the cushioning layer;

and an overcoat laminated over the filler layer.

2. A floor pavement structure according to claim 1, further including an intermediate coat interposed between the filler layer and the overcoat and formed by the application of a liquid resin or a mixture of liquid resin and fine sand.

3. A floor pavement structure according to claim 1, further including a barrier formed on top of the filler layer by the application of a synthetic resin.

4. A floor pavement structure according to claim 1 in which the foaming synthetic resin material of the filler layer comprises foaming polyurethane.

5. A floor pavement structure according to claim 1 in which the filler layer comprises a foaming synthetic resin material containing rubber particles of small diameters.

6. A floor pavement structure according to claim 1 in which the filler layer comprises a foaming synthetic resin material containing fibres.

7. A floor pavement structure according to claim 3 in which the barrier comprises one liquid polyurethane.

8. A floor pavement structure according to claim 4 in which the foaming polyurethane has a foaming factor of 1 to 4.

9. A floor pavement structure according to claim 1 in which the elastic particles of the cushioning layer have an average particle diameter on the order of 1 to 10 mm.

10. A floor pavement structure according to claim 9 in which the elastic particles comprise rubber chips or cork chips.

11. A floor pavement structure according to claim 1 in which the elastic particles comprise rubber chips or cork chips.

* * * * *